United States Patent [19]

Whittaker et al.

[11] 4,367,899

[45] Jan. 11, 1983

[54] HOLDER ASSEMBLIES FOR SENSITIZED CUTTER TOOLS ON MINING MACHINES

[75] Inventors: Raymond A. Whittaker; Raymond Lukaszewicz; John A. Ford, all of Burton-on-Trent, England

[73] Assignee: Coal Industry (Patents) Limited, London, England

[21] Appl. No.: 223,799

[22] Filed: Jan. 9, 1981

[30] Foreign Application Priority Data

Jan. 11, 1980 [GB] United Kingdom ..... 8001019

[51] Int. Cl.[3] ..... E21C 35/08

[52] U.S. Cl. ..... 299/1; 73/85

[58] Field of Search ..... 299/1; 175/39, 50; 73/84, 85

[56] References Cited

U.S. PATENT DOCUMENTS

| | | | |
|---|---|---|---|
| 2,620,386 | 12/1952 | Alspaugh et al. | 73/85 |
| 2,752,591 | 6/1956 | Felbeck et al. | 299/1 X |
| 2,798,710 | 7/1957 | Heimaster | 299/1 |
| 3,056,952 | 10/1962 | Heimaster et al. | 73/84 |
| 3,102,718 | 9/1963 | Eberle | 299/1 |
| 3,550,959 | 12/1970 | Alford | 299/1 |

*Primary Examiner*—Ernest R. Purser

*Attorney, Agent, or Firm*—Stevens, Davis, Miller & Mosher

[57] ABSTRACT

A holder assembly for a sensitized cutter tool mountable on a cutter head of a mining machine comprises a holder adapted to hold the tool. The holder is pivotal supported abutting a mounting sensor means provided to sense cutting reaction on the tool, the cutting reaction tending to urge the holder to pivot about the mounting.

8 Claims, 3 Drawing Figures

HOLDER ASSEMBLIES FOR SENSITIZED CUTTER TOOLS ON MINING MACHINES

This invention relates to cutter tool holder assemblies for retaining sensitized cutter tools on a cutter head of a mining machine. A sensitized cutter tool enables a cutting characteristic of rock and/or mineral to be sensed as the tool is cutting.

In particular, although not exclusively, the present invention relates to holder assemblies for sensitized cutter tools mounted on rotary cutter heads of mining machines.

One prior known rotary cutter is described in the assignee's prior British patent specification No. 1,219,159. Such a rotary cutter for a mineral mining machine comprised a rotary cutter head, cutter tools fixedly mounted on, and distributed around, the head, a cutter tool resiliently mounted on the head and so positioned relatively to one of the fixedly mounted cutter tools that the penetration of the resiliently-mounted tool over at least a substantial part of its cutting path is shallow and constant, and means which are sensitive to relative movement between the resiliently-mounted tool and said one fixed tool and which are adapted to derive a signal indicative of said relative movement.

The resiliently mounted cutter tool was carried in a holder supported on a generally 'I'-section member such that the web of the member provided a resilient mounting for the cutter tool. Unfortunately, the generally 'I'-section member was unable to withstand the constant repetitive deformation occurring during cutting and within a relatively short period of time the generally 'I'-section member broke due to fatigue.

An object of the present invention is to provide an improved holder assembly for a sensitized cutter tool on a mining machine which tends to overcome or reduce the above mentioned problem encountered with prior known equipment.

According to the present invention a holder assembly for a sensitized cutter tool mountable on a cutter head of a mining machine, comprises a holder adapted to hold the sensitized cutter tool, a pivotal mounting which, in use when the holder assembly is mounted on the cutter head, pivotally supports the holder with respect to cutter head, and sensor means arranged for sensing cutting reaction on the cutter tool, said cutting reaction tending to urge the holder to pivot about the pivotal mounting.

Preferably, the sensor means is adapted to derive a signal indicative of the sensed cutting reaction.

Preferably, the pivotal mounting is supported by an inner component of the holder assembly, the inner component being releasably fixedly engaged in a recess defined by an outer component of the holder assembly.

Advantageously, the pivotal mounting comprises a pivot pin bridging two opposed side walls of the inner component.

Preferably, sensor means comprises a sensor head abutting the holder.

Preferably, means are provided for applying a pre-load to the sensor head.

Advantageously, the means comprises a resilient component arranged to urge the holder towards abutment with the sensor head.

Preferably, the outer component comprises an electrical compartment for accommodating an electrical cable for feeding the derived signal to control means for controlling the mining machine's steering mechanism.

Preferably, the inner component comprises a further tool holder located in advance of the first mentioned holder, said further tool holder fixedly mounted with respect to the cutter head.

The present invention also provides a sensitized cutter tool assembly for mounting on a rotary cutter head of a mining machine, in use the cutter being mounted on a drive shaft of the mining machine for rotation about the shaft axis, the sensitized cutter tool assembly comprising sensitized cutter tool for sensing cutting reaction, a holder adapted to hold the sensitized cutter tool, a pivotal mounting which, in use when the assembly is mounted on the cutter head, pivotally supports the holder with respect to the cutter head, and sensor means arranged for sensing the pivotal mounting.

Preferably, the pivotal axis of the pivotal mounting is arranged substantially to lie on a line extending between the rotational axis of the cutter head and the cutting margin of the sensitized cutter tool.

Advantageously, the sensor means comprises a sensor head abutting the holder.

Preferably, the line of reaction between the sensor head and the holder substantially is normal to the direction of the cutting reaction on the sensitized cutter tool.

Preferably, the sensor means is adapted to derive a signal indicative of the sensed cutting reaction.

Preferably, the pivotal mounting is supported by an inner component of the holder assembly, the inner component being releasably, fixedly engaged in a recess defined by an outer component of the holder assembly.

Advantageously, means are provided for applying a pre-load to the sensor.

By way of example only, one embodiment of the present invention will be described with reference to the accompanying drawings, in which.

Figure 1:
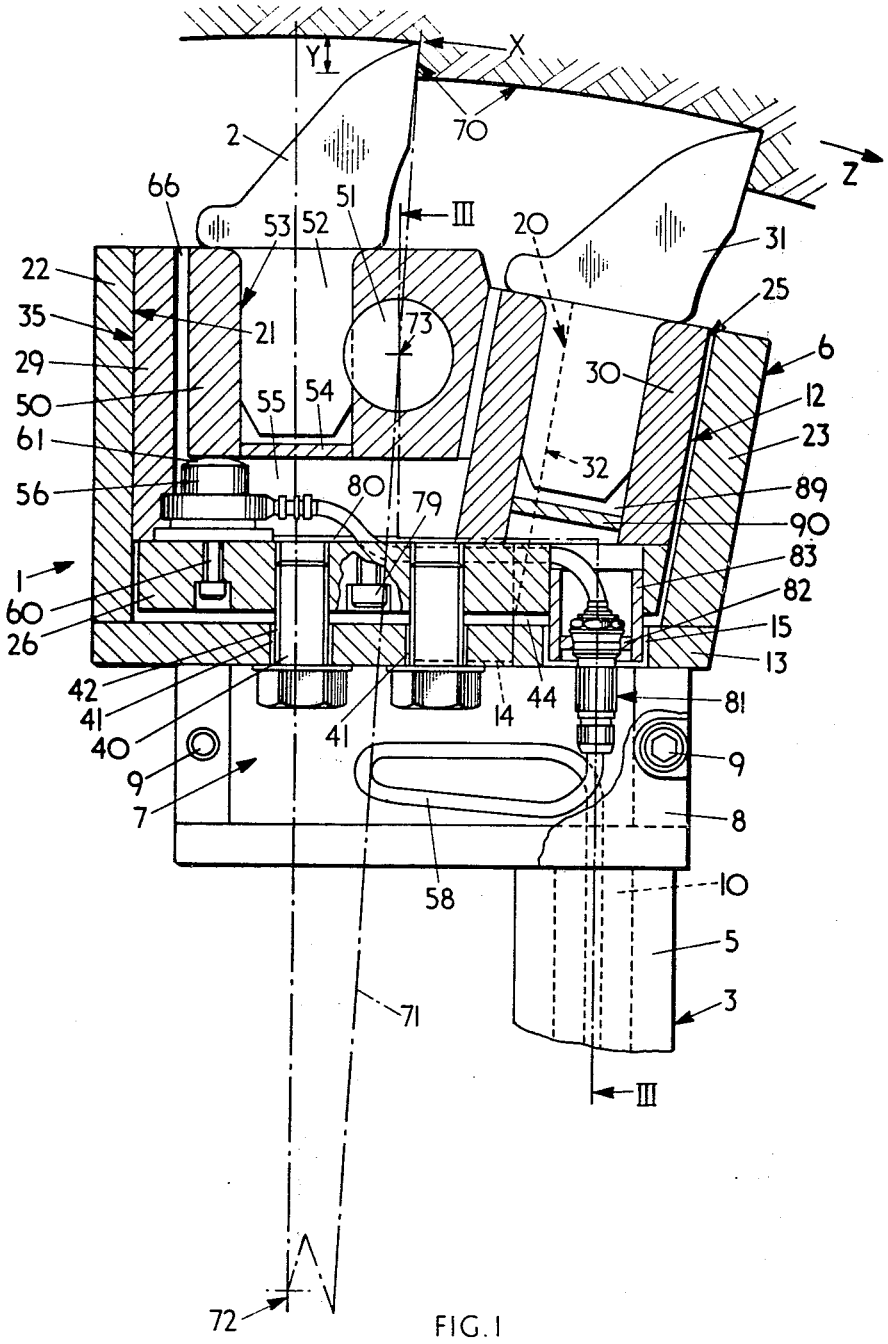
FIG. 1 is a sectional side elevation through a holder assembly for a sensitized cutter tool on a cutter head of a mining machine, the section substantially being taken along line I—I of FIG. 2.

The drawings show a holder assembly 1 for a sensitized cutter tool 2 (omitted on FIGS. 2 and 3), mounted on a mineral rotary cutter head 3 (only portions of a hub 4 and of an upstanding cut mineral guide 5 are shown). In use, the cutter head 3 is drivably mounted on a drive shaft assembly (not shown) of a mineral mining machine which during cutting operations traverses to and fro along a longwall face winning mineral from the working face. The drive shaft assembly may be mounted on the machine body or alternatively, it may be mounted on an arm or boom pivotally mounted with respect to the machine body.

In different installations, the present invention may be mounted on a rock or rock/mineral cutting machine.

The sensitized cutter tool 2 which enables a cutting characteristic of the rock and/or mineral to be sensed is described in more detail later in the specification.

The holder assembly 1 comprises an outer component 6 having a generally open box-like formation fixedly secured to the upstanding out mineral guide 5 by welding and including an electrical connection compartment 7 having a removable side lid 8 (only a part of which is shown in FIG. 1) retained in a closed position by two bolts 9. The compartment 7 communicates with a passage 10 extending along the upstanding guide 5 and a further passage 11 extending around the hub to the base of the upstanding guide.

The compartment 7 also communicates with a recess 12 defined by the box-like formation of the outer component 6. The base 13 of the outer component 6 is provided with a relatively short slotted keyway 14 as well as a passage 15 providing the previously mentioned electrical connecting passage with the component 7.

Figure 2:
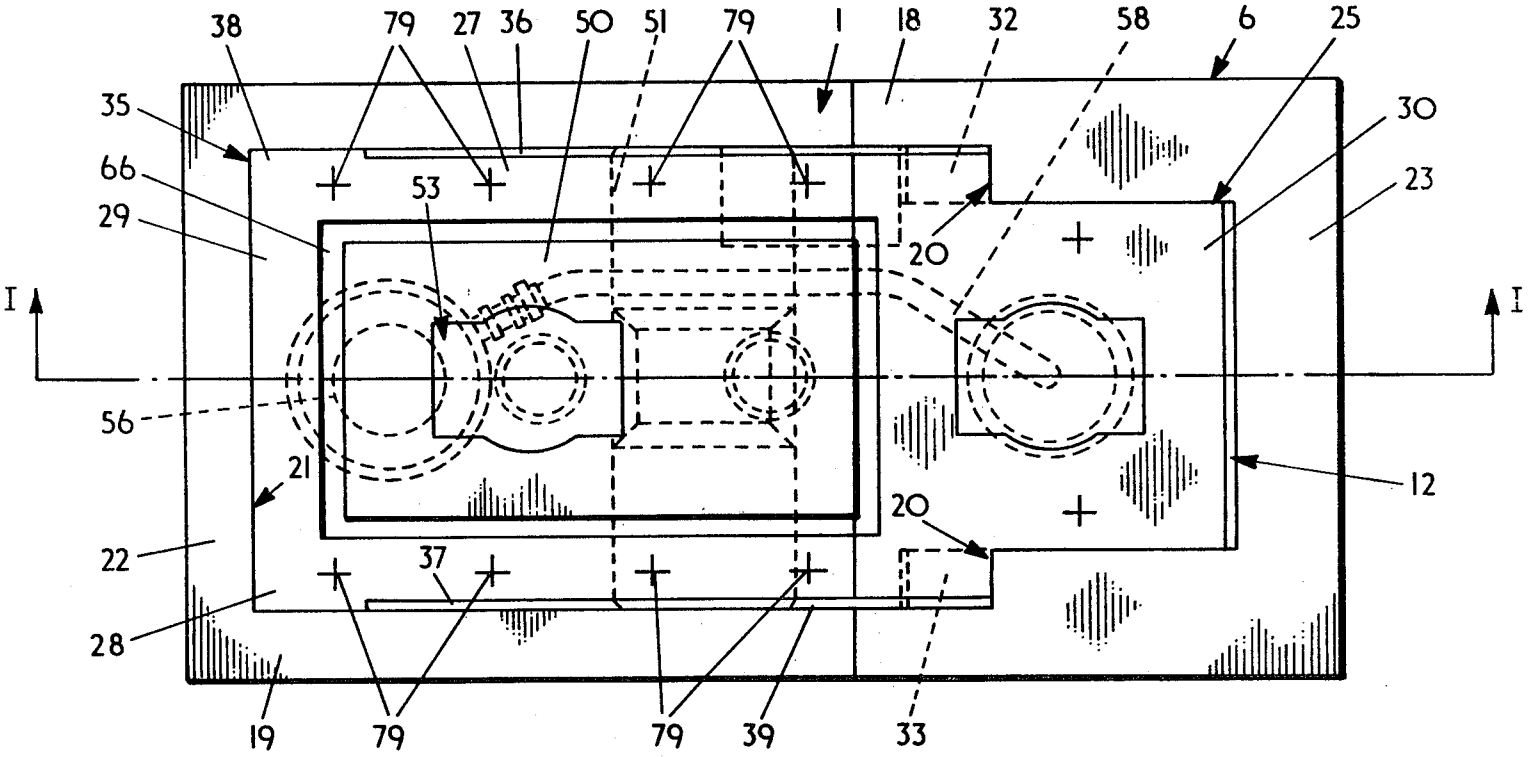
FIG. 2 is an incomplete plan of the holder assembly of FIG. 1.

As seen in FIG. 2 the two opposed side face plates 18 and 19 of the outer component 6 are stepped to define an interrupted abutment face 20 which as indicated in FIGS. 1 and 2 is inclined relative to the base 13.

A further abutment face 21 is defined by the end face plate 22 of the outer component. The leading margin of the outer component 6 is formed by a face plate 23 which as seen in FIG. 1 is inclined relatively to the base 13.

An inner component 25 having a general outer shape somewhat similar to the inner profile defined by the recess 12 is engageable within the recess, the inner component comprising a base plate 26, two opposed side face plates 27 and 28 and a rear face plate 29. The front of the inner component is closed by a tool holder 30 for a fixedly mounted cutter tool 31, the tool holder being integral with the two face plates 27 and 28 and arranged to project outwardly beyond the leading end faces 32 and 33 of the end face plates which end faces are inclined relatively to the base plate 26 so as to form an interrupted abutment face co-operating with the inclined interrupted abutment face 20 defined by the outer component 6.

The two opposed side plates 27 and 28 are secured to the base 26 by bolts 79, the lower margins of the two plates 27, 28 abuting lugs 80 upstanding from the base 26.

The rear face plate also defines a further abutment face 35 for co-operating with said further abutment face 21 defined by the end face plate 22 of the outer components.

From FIG. 2 it will be appreciated that the inner component 25 is inserted into the recess 12 defined by the outer component 6 in a direction substantially normal to the recess base 13 until the abutment faces 32, 33 and 35 abut the corresponding abutment faces 20 and 21 respectively. Once the abutment faces are in contact the inner component 25 is prevented from movement in a direction substantially normal to the abutment face 20, i.e. in a direction substantially in line with the substantial cutting forces exerted on the cutting tools 31 and 2 as will be explained later in this specification.

The outward facing faces of the two opposed side face plates 27 and 28 are cut away at 36 and 37 such that only the rear margins 38 and 39 of these plates abut the inward facing opposed side face of the side face plates 18 and 19. Thus, the inner component 25 tends to be held against movement in a direction transverse to the said direction substantially in line with the substantial cutting forces.

The inner component 25 is releasably retained in the recess 12 defined by the outer component by two bolts 40 the heads of which abut the lower most face of the base 13 of the outer component 6 and the threaded shafts of which pass through bores 41 provided in the base 13 to fixedly engage in threaded bores 42 provided in the base plate 26 of the inner component 25. The bolts 40 are inserted into the locating position as shown in FIG. 1 via the previously mentioned electrical connecting compartment 7.

Figure 3:
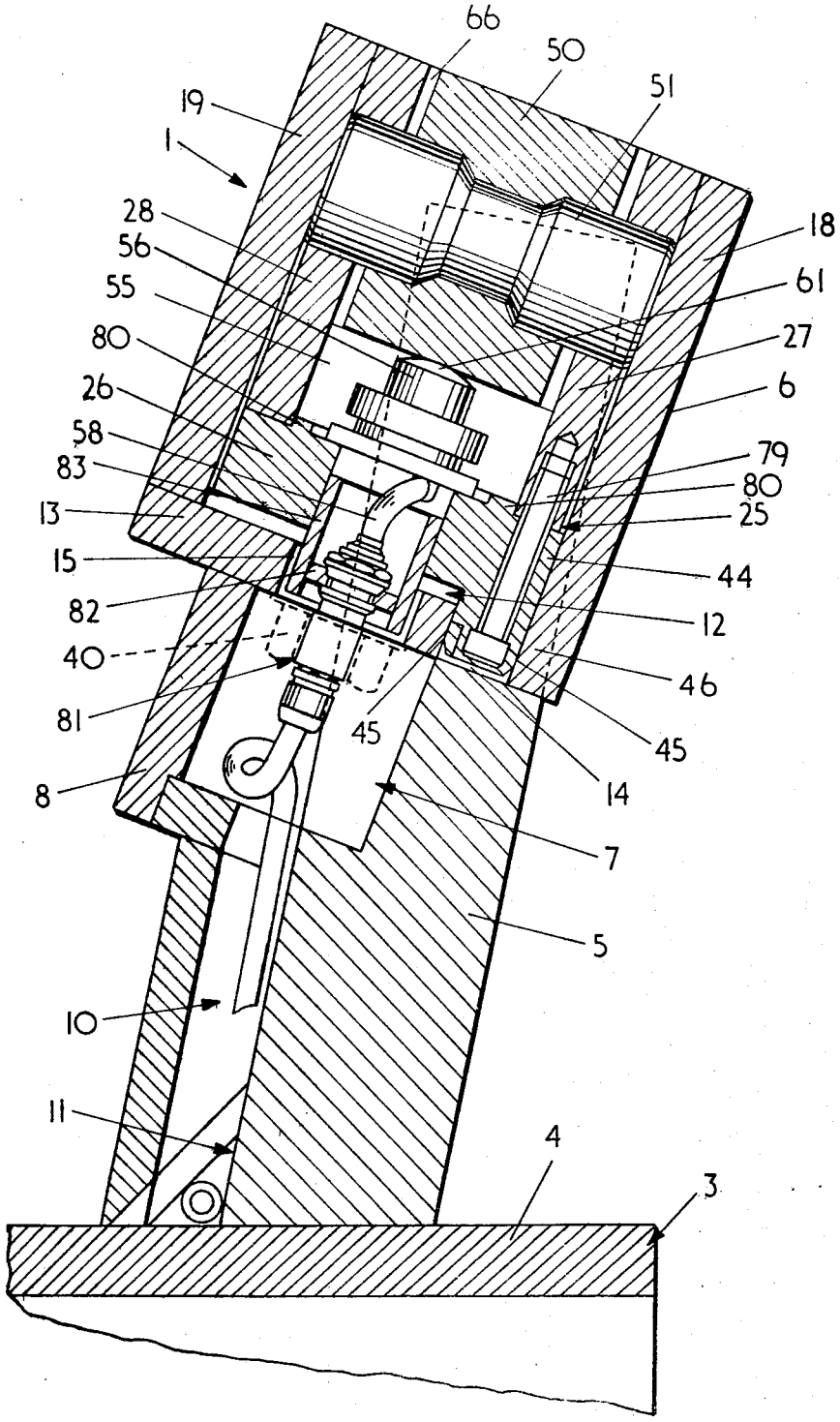
FIG. 3 is an incomplete sectional view substantially taken along line III—III of FIG. 1.

The base plate 26 of the inner component is provided with a key 44 shown longitudinally out of position in FIG. 3 for the sake of clarity for engagement in the previously mentioned slotted keyway 14 provided in the base 13 of the outer component, the outward facing side faces 45 of the key abutting the associated inward facing side faces 46 on the keyway. Thus, the inner component 25 is fixedly retained within the recess 12 and is able to withstand the substantial cutting forces.

The inner component 25 supports a tool holder 50 for the previously mentioned sensitized cutter tool 2, the holder 50 being secured to the side face plates 27 and 28 of the inner component by a substantial pivot pin 51 which bridges the two side plates. As seen in FIG. 2 the central margin of the pivot pin is stepped so as to avoid interference with the rectangular shank 52 of the cutter tool 2 which shank is releasably fixedly engaged within a generally rectangular passage 52 provided in the holder 50. The lower most end of the passage 53 is closed by a plate 54 which prevents broken rock and/or mineral particles penetrating into a chamber 55 which houses a sensor 56 for sensing cutting forces exerted on the sensitized cutter tool 2 as will be explained later in this specification and which is at least partly filled with potting compound. The sensor 56 is adapted to derive a signal indicative of the cutting characteristics of the rock and/or mineral and to feed the derived signal along an electric cable 58 which extends along the chamber 55 and via the previously mentioned passages 15, 7, 10 and 11 to control means arranged to control the cutting horizon of the cutter head in response to the derived signal. An electrical connector 81 is located in the passage 15, one portion of the connector 81 being fixedly secured to an annulus 82 fixedly secured to a locating bush 83 secured to the base plate 26 of the inner component 25. The holder 30 for the cutter tool 31 has a recess 89 for receiving the tool shank, the base of the recess being closed by a plate 90.

The sensor 56 is retained in position on the base 13 by a locating bolt 60, the sensitive head 61 of the sensor being abutted by the base of the holder 50 substantially to prevent pivotal movement of the holder about the pivot pin 51 in an anti-clockwise direction as seen in FIG. 1. Thus, any cutting reaction taken by the sensitized cutter tool 2 while cutting through the mineral and/or rock and tending to pivot tool holder 50 about the pivot pin 51 is sensed by the sensitive head 61 of the sensor which as previously mentioned derives a signal indicative of the cutting force. In FIG. 1 with the cutter head rotating in a clockwise direction as indicated by arrow Z the cutting force exerted on the sensitized cutter tool 2 is indicated by arrow X. It will be appreciated that the fixedly mounted leading cutter tool 31 cuts mineral and/or rock to leave a cut profile 70. Thereby, the sensitized cutter tool 2 which follows close behind, and in the same cutting path as, the cutter tool 31 is required to cut a relatively shallow and substantially constant depth of cut (indicated by Y) for at least a portion of its cutting traverse. Typically the depth of cut taken by the sensitized cutter tool 2 is 12.5 mm. Since the sensitized cutter tool cuts a substantially constant depth of mineral and/or rock it follows that any substantial variations in the cutting reaction exerted on the cutter tool accrues from variations in the cutting characteristic of material being cut. Consequently, it frequently is possible to identify a cutting characteristic pattern within the band or seam of material being cut by the rotary cutter head and by comparing the cutting characteristic pattern derived from the signal fed from the sensor 56 with a preselected desired pattern to steer the cutter head to cut within a desired cutting horizon.

The line of reaction between the sensor head 61 of the sensor means and the holder 50 substantially is normal to the direction of the cutting reaction of the sensitized cutter tool.

FIG. 1 shows that the cutting margin 70 of the sensitized cutter tool 2 lies along a line 71 extending through the rotational axis 72 of the cutter head 3 (the axis 72 being shown out of position in FIG. 1) and through the pivotal axis 73 of the pivot pin 51. Such an arrangement tends to ensure that only cutting reaction forces in the direction indicated by arrow X are sensed by the Sensor 56. Other unpredictable and undesired forces derived during cutting which tend to have substantial component forces acting in a direction substantially normal to direction X tend to act through the pivotal axis 73 and therefore tend not to affect sensor 56.

Typically, the sensor 56 is a piezoelectric sensor as for example a 200 A20 Impact Transducer manufactured by PCB Piezotronics Inc. of Buffalo New York and marketed in the United Kingdom by Technimeasure, Dell House, Kastern Dene, Hazemore, High Wycombe, H8157BT.

Alternatively, the sensor may comprise a strain gauge device.

As shown in the drawings, a resilient pad 66 is provided around the pivotally mounted holder 30, the resilient pad tending to act to preload the sensor 56. Also, the resilient pad tends to prevent broken rock and/or mineral particles entering the sensor chamber 55.

In operation, the assembled inner component 25 is located in the recess 12 of the outer component 6 by relative movement of the inner component in a direction substantially normal to the cutting direction. Once the inner component is located in the recess 12 with the abutment faces 20 and 32 and 33 and 21 and 35 in engagement the bolts 40 are located in position to fixedly secure the components together. The bolts 40 are located in position via the electrical compartment 7 with the temporary removal of the compartment lid 8. Also, the two components of the electrical connector 81 are connected and the picks 2 and 31 placed in their respective holders 50 and 30.

Thus, during the cutting operation, the transient cutting characteristics acting on the sensitized cutter tool 2 are sensed by the sensor 56 which derives a signal measurably indicative of the sensed cutting characteristic. This derived signal is fed to a machine steering control and is compared with a signal indicative of the angular position of the rotating sensitized cutter tool 2 and a cutting characteristic pattern derived which is compared with a preselected desired cutting characteristic pattern. The comparison of the derived and the desired pattern is used to steer the cutting head along a desired cutting horizon. The line of reaction between the sensor head and the holder substantially is normal to the direction of the cutting reaction on the sensitized cutter tool.

Alternatively, instead of comparing cutting characteristic patterns it may be preferred in some installations to compare cutting characteristic peaks. For example, if it is desired to cut a relatively hard rock adjacent to a mineral seam boundary or at a pre-known height within the mineral seam an associated peak signal could be used to steer the machine.

As the cutting force acting on the sensitized cutter tool 2 in the direction X fluctuates the resultant force of the pivotally mounted holder 50 on the sensor 56 varies correspondingly and thereby signal indication of the cutting force is derived.

From the above description it will be appreciated that the present invention provides equipment which tends to overcome or reduce problems associated with prior known equipment.

We claim:

1. A sensitized cutter tool assembly for mounting on a rotary cutter head of a mining machine, the cutter being mounted on a drive shaft of the mining machine for rotation about the shaft axis, the sensitized cutter tool assembly comprising a sensitized cutter tool for sensing cutting reaction, a holder adapted to hold the sensitized cutter tool, a pivotal mounting pivotally supporting the holder with respect to the cutter head, and sensor means arranged for sensing the cutting reaction on the sensitized cutter tool, said cutting reaction tending to urge the holder to pivot about the pivotal mounting, the pivotal axis of the pivotal mounting positioned substantially to lie on a line extending between the rotational axis of the cutter head and the cutting margin of the sensitized cutter tool.

2. A sensitized cutter tool as claimed in claim 1, in which the sensor means comprises a sensor head abutting the holder.

3. A sensitized cutter tool as claimed in claim 2, in which the line of reaction between the sensor head and the holder substantially is normal to the direction of the cutting reaction on the sensitized cutter tool.

4. A sensitized cutter tool assembly as claimed in claim 3, in which the sensor means derives a signal indicative of the sensed cutting reaction.

5. A sensitized cutter tool assembly as claimed in claim 4, in which the pivotal mounting is supported by an inner component of the holder assembly, the inner component being releasably fixedly engaged in a recess defined by an outer component of the holder assembly.

6. A sensitized cutter tool assembly as claimed in claim 5, including means for applying a pre-load to the sensor.

7. A sensitized cutter tool assembly as claimed in claim 6, in which the means comprises a resilient component arranged to urge the holder towards abutment with the sensor.

8. A sensitized cutter tool assembly as claimed in claim 5, in which the inner component comprises a further tool holder located in advance of the first mentioned holder, said further tool holder being fixedly mounted with respect to the cutter head.

* * * * *